United States Patent [19]

Goodbar

[11] 4,209,822

[45] Jun. 24, 1980

[54] LIGHT POLARIZING ILLUMINATION DEVICE

[75] Inventor: Isaac Goodbar, Queens Village, N.Y.

[73] Assignee: Edison Price Incorporated, New York, N.Y.

[21] Appl. No.: 834,190

[22] Filed: Sep. 19, 1977

[51] Int. Cl.[2] ..... F21V 9/00; F21V 9/14

[52] U.S. Cl. ..... 362/19; 362/217; 362/326; 362/330; 362/223; 362/332

[58] Field of Search ..... 362/97, 127, 217, 222, 362/326, 330, 293, 351, 355, 327, 2, 223, 309, 311, 19, 33, 98, 141-143, 268, 260, 292, 332; 312/156

[56] References Cited

U.S. PATENT DOCUMENTS

| | | | |
|---|---|---|---|
| 2,302,556 | 11/1942 | Kriebel | 350/156 |
| 2,302,613 | 11/1942 | Land | 362/19 |
| 2,402,176 | 6/1946 | Marks | 362/19 |
| 3,258,590 | 6/1966 | Goodbar | 362/339 |
| 3,370,111 | 2/1968 | Boone | 350/153 |
| 3,676,845 | 7/1972 | Siksai | 350/159 |
| 3,912,921 | 10/1975 | Howe et al. | 362/19 |
| 4,054,793 | 10/1977 | Shemitz | 362/127 |

FOREIGN PATENT DOCUMENTS

| | | | |
|---|---|---|---|
| 1049266 | 11/1966 | United Kingdom | 362/33 |

*Primary Examiner*—Stephen C. Bentley
*Assistant Examiner*—Edward F. Miles
*Attorney, Agent, or Firm*—McAulay, Fields, Fisher & Goldstein

[57] ABSTRACT

A desk or other work table has a long horizontal work surface above which is mounted one or more suitably housed linear fluorescent lamps extending for about the length of the work surface and at about eye level. A plurality of side-by-side light polarizing panels are supported below the lamp, the polarization planes of each panel being vertical and these vertical polarization planes of the group of panels converge toward a medial area where the visual task is to be located.

7 Claims, 5 Drawing Figures

LIGHT POLARIZING ILLUMINATION DEVICE

BACKGROUND OF THE INVENTION

The present invention relates generally to improvements in illumination devices, and it relates particularly to an improved work bench provided with an arrangement which optimally illuminates with a minimum of glare a work piece located in a usual position of the bench work surface.

Unpolarized or ordinary light consists of visible electromagnetic waves having transverse vibrations of equal magnitude in an infinite number of planes, all of which contain the line representing the direction of propagation (light ray).

In explaining the properties of polarized light, it is common to resolve the amplitude of the vibrations of any light ray into components vibrating in two orthogonal planes, each containing the light ray. One of these planes is usually chosen perpendicular to the plane of the visual task and will be referred to herein as the plane of incidence. Accordingly, the two components of light will be referred to as (1) the parallel component or the component in the plane of incidence, and (2) the perpendicular component.

When the parallel component reaches a dielectric visual task, such as a piece of paper, only a small part of it is specularly reflected. To the contrary, a substantial part of a perpendicular component is specularly reflected.

The light specularly reflected at the task increases the luminance (photometric brightness) of both the lightest and darkest parts of the task, in certain viewing directions, thereby reducing its contrast and making it more difficult to see any details.

It was discovered, as the literature makes clear, that the task contrast could be enhanced by eliminating all or part of the perpendicular component, i.e. by polarizing the light in a parallel direction.

Recently, furniture with built-in luminaires has become popular. One arrangement which attempts to provide a satisfactory visual contrast includes, below the fluorescent lamps, a linear polarizer which eliminates the component vibrating in planes parallel to the fluorescent tubes. By mounting the luminaire at or below eye level, the direct glare is eliminated completely. The reflected glare is reduced as long as the observer looks at the work in a plane perpendicular to the fluorescent tubes. However, if the work or task is laterally moved or is angularly shifted to a position, for example, to rotate the viewing angle 45 degrees, the light reaching it will vibrate in a perpendicular plane and, therefore, instead of increasing, it will be reducing the task contrast and increasing the reflected glare.

SUMMARY OF THE INVENTION

It is a principal object of the present invention to provide an improved illumination device.

Another object of the present invention is to provide an improved device for illuminating a visual task or work being examined or studied with a minimum of glare and with a maximum of contrast and resolution.

Still another object of the present invention is to provide an improved low-glare-producing elongated illumination device.

A further object of the present invention is to provide an improved desk, table or the like having a low-glare illumination arrangement located above and extending for a great part of the width of the bench work surface.

Still a further object of the present invention is to provide devices of the above nature characterized by their reliability, low cost, simplicity, and great versatility and adaptability.

The above and other objects of the present invention will become apparent from a reading of the following description taken in conjunction with the accompanying drawings which illustrate a preferred embodiment thereof.

In a sense, the present invention contemplates the provision of an improved low-glare illumination device including a light source extending along a longitudinal axis, and a light polarizing filter extending along the length of the light source and having vertical planes of polarization converging to the task area. Advantageously, the light source is associated with a desk, work table or the like, having a substantially horizontal work surface, and extends for the length of the work surface from side-to-side thereof, and is supported at about eye level above the work surface. In its preferred form, the light source is a suitably housed linearly extending fluorescent lamp provided with a suitable reflector, and the polarizing filter includes side-by-side panels or sections, each panel or section polarizing the light in a vertical polarization plane and such polarization planes approximately converging toward the task area.

Tasks located in the aforesaid medial area may be observed and viewed with a minimum of reflected glare from the illumination source by reason of the unique geometry of the light polarization planes which assures that the light reaching the task is substantially vibrating in the planes of incidence with veiling reflections minimized, thereby maximizing contrast and resolvable detail.

DESCRIPTION OF THE PREFERRED EMBODIMENT

Figure 1:
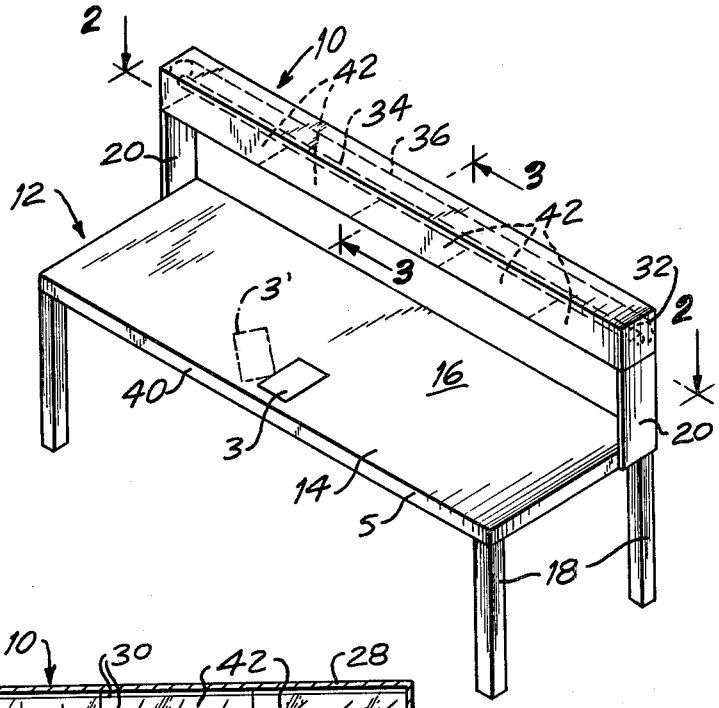
FIG. 1 is a front perspective view of a work table employing an illumination device embodying the present invention.

Referring now to the drawings which illustrate a preferred embodiment of the present invention, reference numeral 10 generally designates the improved illumination device which is associated with a table 12 which may be a desk or other desirable form. Table 12 is of conventional construction and includes a horizontal rectangular top member 14 of greater length from side-to-side than depth, and having a horizontal flat top work surface 16. Vertical legs 18 descend from each corner of the top member 14 and support the top member at any desired or suitable height.

Illumination device 10 is supported above and longitudinally along and above the rear border of work surface 16 for the full width thereof by a pair of upright posts or stands 20 mounted at opposite ends of the rear border of work surface 16. The illumination device is advantageously at about the eye level of an observer 22, normally employing the work surface 16 to support a work piece 24 for observation, study, or examination, such as a book, document, magazine or the like, the observer being in a standing or sitting position, as the case may be. Thus, the distance between the work surface 16 and illumination device 10 is advantageously between about one and two feet.

The illumination device 10 comprises an open-bottomed channel-shaped metal housing 25 including a top wall 26 and descending front and rear walls 28 terminating in inwardly directed coplanar flanges or tabs 30. The opposite ends of housing 25 are closed by end walls 32. A linear elongated fluorescent tube of any desired type extends within and for substantially the full length of the housing 25 and is releasably supported at its ends by conventional mating electrical sockets which are suitably mounted to end walls 32, and electrically engage the fluorescent tube end contacts in the known manner. Also located in the housing and connected to the sockets in the usual manner are a ballast and other appurtenant components. A properly shaped reflector 36 is mounted in the upper part of housing 25 above fluorescent tube 34 and extends along the full length thereof with its concave face being forwardly downwardly directed. While only one fluorescent lamp 34 is illustrated, more than one may be employed either transversely spaced or end-to-end.

In accordance with the present invention, a light polarizing filter 38 registers with the bottom opening of housing 25 and intercepts the light of the light source fluorescent lamp 34 directed toward the work surface 16. The polarizing filter is so optically constructed and oriented that the planes of polarization thereof are vertical and converge toward the area where the task is located. While the filter 30 is illustrated as lying in a flat horizontal plane, it may be cylindrically curved or inclined to the transverse axis.

Figure 2:
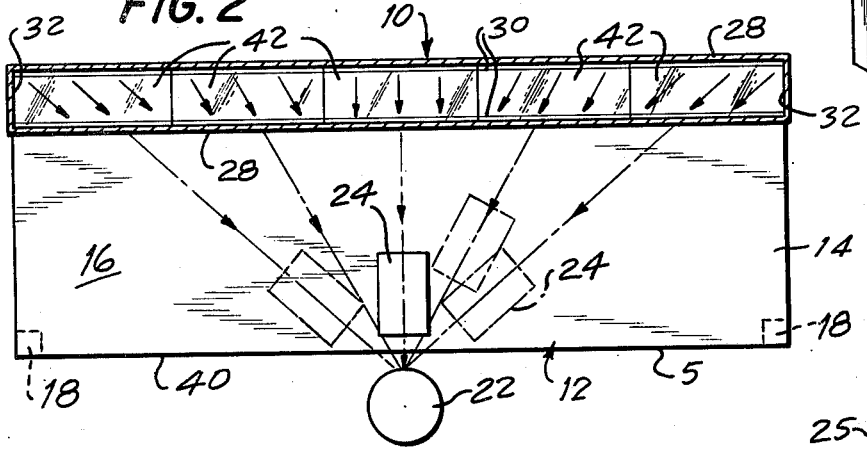
FIG. 2 is a sectional view taken along line 2—2 in FIG. 1.
Figure 3:
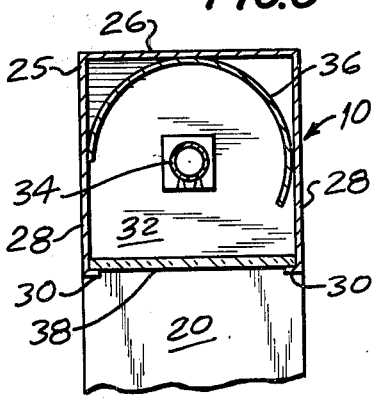
FIG. 3 is a sectional view taken along line 3—3 in FIG. 1.
Figure 4:
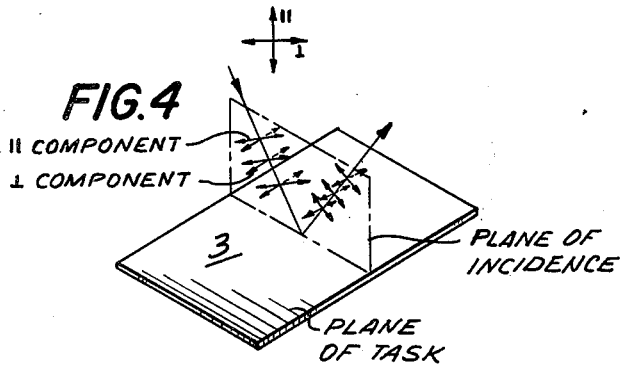
FIG. 4 shows a light ray in its plane of incidence.

As illustrated in the drawings, polarizing filter 38 includes a plurality of side-by-side, individual rectangular polarizing filter elements or panels 42 of flat sheet shape and advantageously formed of dichroic plastic materials such as those marketed under the Polaroid trademark. The polarization planes of each panel, as shown by arrows in FIG. 2, are mutually parallel and vertical and converge towards the area where the task or work piece 3 is to be located. The polarization planes of the medial panel are perpendicular to the fluorescent lamp axis and the angle of the polarization planes of the successively outer adjacent polarization panels 42 form increasingly smaller angles to the fluorescent lamps. While five panels are shown in the illustrated embodiment, this is merely by way of example, since more or fewer panels may be employed.

In employing the improved illuminated table 12, the work piece as 3 to be observed is laid on the work surface 16 in front of a medially positioned observer 22, who thereupon views the work piece under the illumination of the illumination device 10, the light output of which is polarized, as described above. Thus, a major portion of the light from the illumination device incident on the work piece in the direction of the observer is in a plane substantially vertical to the work piece horizontal face whereas only a small fraction of the light incident on the work piece is in planes at a glancing angle to the work piece. Accordingly, the reflected glare-producing illumination is minimized and the work piece may be viewed with a maximum of contrast and resolution.

Figure 5:
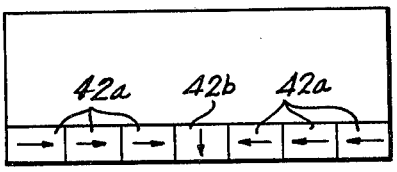
FIG. 5 shows an extreme situaton, where the luminaire is immediately over the desk.

In FIG. 5, an arrangement is illustrated wherein the polarization panels **42*a*, other than the centermost panel 42*b*, are longitudinally aligned towards the centermost panel, above the visual task under examination. It will be noted that panels 42*a*, 42*b* are edge aligned with table 15**.

While there has been described and illustrated a preferred embodiment of the present invention, it is apparent that numerous alterations, omissions and additions may be made without departing from the spirit thereof.

I claim:

1. An illumination device comprising an elongated light source extending along a longitudinal axis, and a light polarizing filter extending below and along the length of said light source and having vertical planes of polarization, the vertical planes of polarization being at right angles to the longitudinal axis of the elongated light source along a medial portion of the filter, the vertical planes of polarization of areas of the filter successively farther removed from the medial portion and extending on each side thereof forming successively smaller angles to the longitudinal axis of the lamp, whereby the vertical planes of polarization converge to a predetermined area, the predetermined area being located longitudinally intermediate the length of said light source and transversely forward thereof.

2. The illumination device claim 1 wherein said light source comprises a linearly elongated fluorescent lamp.

3. The illumination device of claim 1 wherein said light polarizing filter comprises a plurality of side-by-side light polarizing panels each having vertical planes of polarization, the polarization planes of each panel being mutually parallel and directed, converging with the polarization planes of the other panels, towards said predetermined area.

4. An illumination device of claim 1 and including a flat work surface, the device being disposed above and extending along the length of said work surface from side-to-side thereof.

5. The device of claim 4 wherein the illumination device is disposed rearwardly of the forward edge of said predetermined area, and said predetermined area is medially longitudinally located proximate the forward edge of said work surface.

6. The combination of claim 5 wherein said light source comprises a linearly elongated flourescent lamp.

7. The combination of claim 4 wherein said light polarizing filter comprises a plurality of side-by-side light polarizing panels having vertical planes of polarization, the polarization planes of each panel being mutually parallel and converging with the polarization planes of the other panels toward said predetermined area atop the work surface.

* * * * *